US008469487B2

(12) United States Patent
Puigardeu et al.

(10) Patent No.: US 8,469,487 B2
(45) Date of Patent: Jun. 25, 2013

(54) INKJET PRINTING APPARATUS AND METHOD FOR PRINTING A PLURALITY OF PIXELS

(75) Inventors: Sergio Puigardeu, Barcelona (ES); Luis Garcia, Les Roquetes Barcelona (ES); M. Isabel Borrell, Barcelona Manresa (ES); Marc Serra, Barcelona (ES); Angel Martinez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 452 days.

(21) Appl. No.: 12/789,808

(22) Filed: May 28, 2010

(65) Prior Publication Data

US 2011/0292111 A1 Dec. 1, 2011

(51) Int. Cl.
*B41J 2/165* (2006.01)

(52) U.S. Cl.
USPC ..... 347/35; 347/14; 347/15; 347/41

(58) Field of Classification Search
None
See application file for complete search history.

(56) References Cited

U.S. PATENT DOCUMENTS

| | | | | |
|---|---|---|---|---|
| 4,313,123 | A | 1/1982 | Jinnai et al. | |
| 6,471,332 | B1 * | 10/2002 | Vilanova et al. | 347/43 |
| 7,290,854 | B2 * | 11/2007 | Mizutani et al. | 347/41 |
| 7,588,313 | B2 * | 9/2009 | Kawaguchi et al. | 347/35 |
| 2006/0114279 | A1 | 6/2006 | Iwao | |

FOREIGN PATENT DOCUMENTS

| | | | |
|---|---|---|---|
| JP | 2006116730 | A | 5/2006 |
| JP | 2008100529 | A | 5/2008 |

* cited by examiner

*Primary Examiner* — Uyen Chau N Le
*Assistant Examiner* — Chad Smith

(57) ABSTRACT

In a method for printing a plurality of pixels, each pixel of a plurality of pixels is printed by controlling an inkjet print head to provide for each pixel at least two ink drops at different positions in a print head movement direction, the print head having a plurality of trenches supplying ink to a plurality of sets of nozzles. The at least two ink drops forming first pixels of said plurality of pixels are fired from the same trench.

20 Claims, 8 Drawing Sheets

INKJET PRINTING APPARATUS AND METHOD FOR PRINTING A PLURALITY OF PIXELS

BACKGROUND

The invention relates to the field of inkjet printing and, more specifically to an inkjet apparatus and a method for printing a plurality of pixels.

In the field of inkjet printing, for example in the field of large format printing of CAD plots or the like, when printing black lines only, the throughput for printing may be increased by using a dual pigmented black print head, also referred to as dual matte black print head or DK print head. In such a print head two separate reservoirs are provided and ink is supplied from these reservoirs to associated sets of inkjet nozzles by two trenches filled with matte black ink from the reservoir. The ink is fired from these trenches, more specifically from the respective sets of inkjet nozzles associated with the respective trench. This allows printing at the double carriage speed while maintaining firing frequencies for the print head which remain within acceptable ranges. This increases the throughput when printing for example line art only, like black line CAD plots as they are generated for example by architects.

One problem with pigmented inks used in thermally actuated print heads is that in case the print head has been idle for a specific time, for example for more than one second, ink drops with a correct volume and shape may only be obtained after having fired a few drops immediately before. Typically, three ink drops are enough to get a good drop volume and shape. The lack of appropriate volume or shape may result in a line roughness of a printed line that is clearly visible to the user in the printout or hard copy.

SUMMARY OF THE INVENTION

Embodiments of the invention concern a method for printing a plurality of pixels, the method including printing each pixel of a plurality of pixels by controlling an inkjet print head to provide for each pixel at least two ink drops at different positions in a print head movement direction, the print head having a plurality of trenches supplying ink to a plurality of sets of nozzles, wherein the at least two ink drops forming first pixels of said plurality of pixels are fired from the same trench.

Embodiments of the invention concern an inkjet printing apparatus, including an inkjet print head including a plurality of reservoirs configured to hold ink, a plurality of sets of nozzles configured to fire ink drops, a plurality of one or more trenches configured to supply ink from a respective ink reservoir to an associated set of nozzles. The inkjet printing apparatus includes a controller configured to control the inkjet print head such that each pixel of a plurality of pixels is printed by controlling the inkjet print head to provide for each pixel at least two ink drops at different positions in a print head movement direction, the print head having a plurality of trenches supplying ink to a plurality of sets of nozzles, wherein the at least two ink drops forming first pixels of said plurality of pixels are fired from the same trench.

BRIEF DESCRIPTION OF THE DRAWINGS

FIG. 3(*b*) shows a single-dotting mask that was used to print the vertical lines shown in FIG. 3(*a*);

FIG. 4(*b*) shows a double-dotting mask in accordance with an embodiment of the invention that was used to print the vertical lines shown in FIG. 4(*a*);

DESCRIPTION OF EMBODIMENTS OF THE INVENTION

Figure 1:
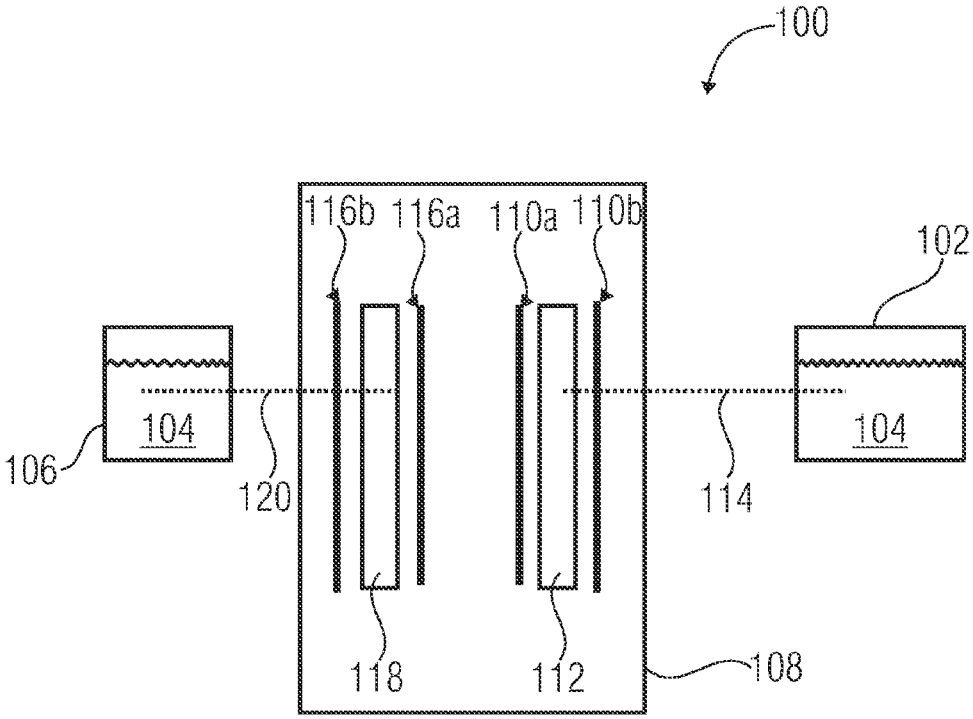
FIG. 1 is a schematic representation of a dual matte black print head (DK printhead) used in embodiments of the invention.

FIG. 1 is a schematic representation of a dual matte black print head (DK print head) 100 as it may be used in an embodiment of the invention. It is noted that the invention is not limited to the specific kind of print head depicted in FIG. 1 and that any other kind of print head allowing the firing of different sets of nozzles independent from each other may be employed. The print head 100 includes a first ink reservoir 102 that is filled with black ink 104. The print head 100 comprises a second ink reservoir 106 that is also filled with black ink. In an embodiment of the invention using a dual matte black print head, both reservoirs 102 and 106 are filled with the same ink 104, namely pigmented black ink or matte black ink. The invention is not limited to such an arrangement, rather, embodiments of the invention may employ different inks in the first and second reservoirs 102, 106 dependent on what is to be printed. For example, different kinds of black ink may be provided for obtaining specific effects. Other embodiments may provide inks of different color for obtaining a desired color of the line art being different from black.

The print head 100 further includes a heater chip 108. On the heater chip 108 a first set of print nozzles 110*a*, 110*b* is provided. The ink nozzles are only shown schematically as thick black lines and any known configuration for realizing the first set of inkjet nozzles 110*a*, 110*b* may be used. The first set of inkjet nozzles 110*a*, 110*b* is supplied with ink via a first trench or ink fill slot 112 that is in fluid communication with the first reservoir 102 for supplying ink 104 from the reservoir 102 to the first set of inkjet nozzles 110*a*, 110*b*. The fluid connection is schematically represented by the dotted line 114 shown in FIG. 1. The print head 100 also comprises a second set of nozzles 116*a*, 116*b* having the same or a similar configuration as the inkjet nozzles of the first set 110*a*, 110*b*. These nozzles are supplied with ink via a second trench or ink fill slot 118 which is in fluid communication with the second reservoir 106 as is represented schematically by the dotted line 120.

FIG. 1 shows an example of a configuration of a print head 100 as it may used in an embodiment of the invention. However, other configurations of print heads are known in which, for example, each set of nozzles is supplied with ink by two trenches. Also, more than two sets of inkjet nozzles may be provided in an inkjet print head. Also, such modified print heads may be used in an embodiment of the invention. Embodiments of the invention may use a printhead having a single reservoir only. In such a printhead ink is supplied from such a single reservoir via the trenches to the sets of inkjet nozzles.

Figure 2:
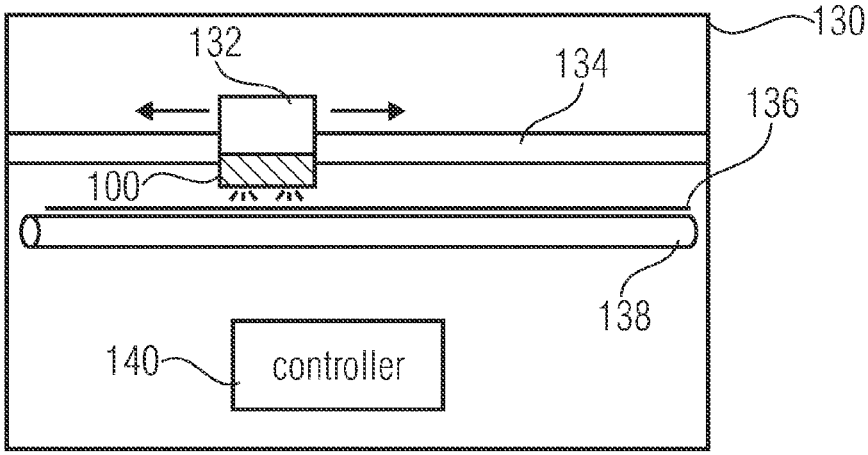
FIG. 2 is a schematic representation of an inkjet apparatus of an embodiment of the invention.

FIG. 2 is a schematic representation of an inkjet printing apparatus of an embodiment of the invention, for example a conventional desktop inkjet printing device or a large scale inkjet plotting device. The inkjet printer 130 comprises a print head 100, like the one described above with regard to FIG. 1. The print head 100 is mounted to a carriage 132 that is moveably mounted on a rod to allow the carriage 132 having attached thereto the print head 100 to reciprocate in the directions as indicated by the arrows in FIG. 2. This allows moving the print head 100 over the entire width of a print medium 136 that is supported by a platen or a platen roller 138. The print medium 136 may be paper, however the invention is not limited to such media. Rather, any kind of media on which marks can be applied using the inkjet technology may be used, for example foils and the like. The print medium 136 is advanced in a direction perpendicular to the surface of the drawing of FIG. 2 so that by reciprocating the carriage 132 and movement of the print medium 136 all or part of the surface of the print medium may be printed.

In addition, the inkjet printer 130 comprises a controller 140 that controls all elements in the printer 130 needed for generating a printout. For example, the controller 140 receives the necessary print data, and, on the basis of the print data, generates the necessary control signals for operating the respective nozzles of the print head 100 and the movement of the carriage 132 along the rod 134 as well as the necessary control signals for actuating feeding elements for moving the print medium 136. In addition, the controller 140 will provide a control to the print head 100 in accordance with embodiments of the invention, which will be described in further detail below.

Figure 3A:
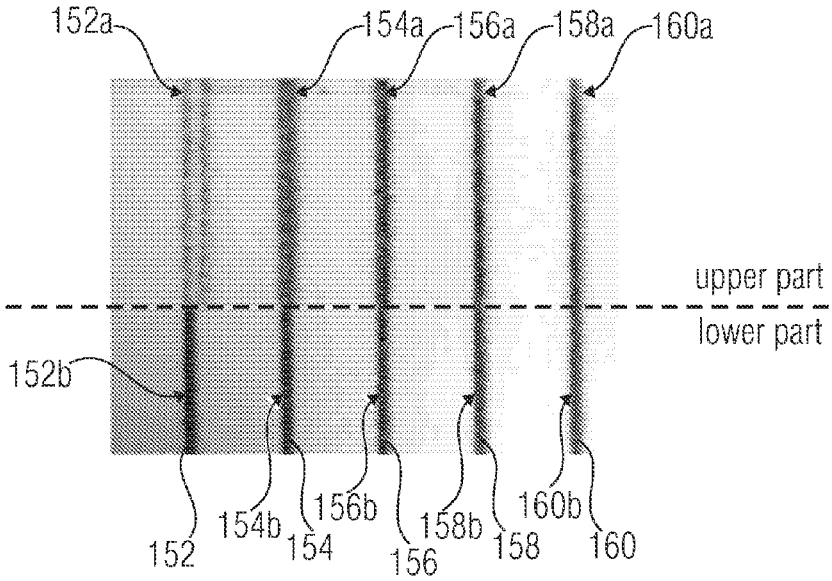
FIG. 3(*a*) is a photographic representation of vertical black lines printed with a DK print head using a single-dotting mask.
Figure 3B:
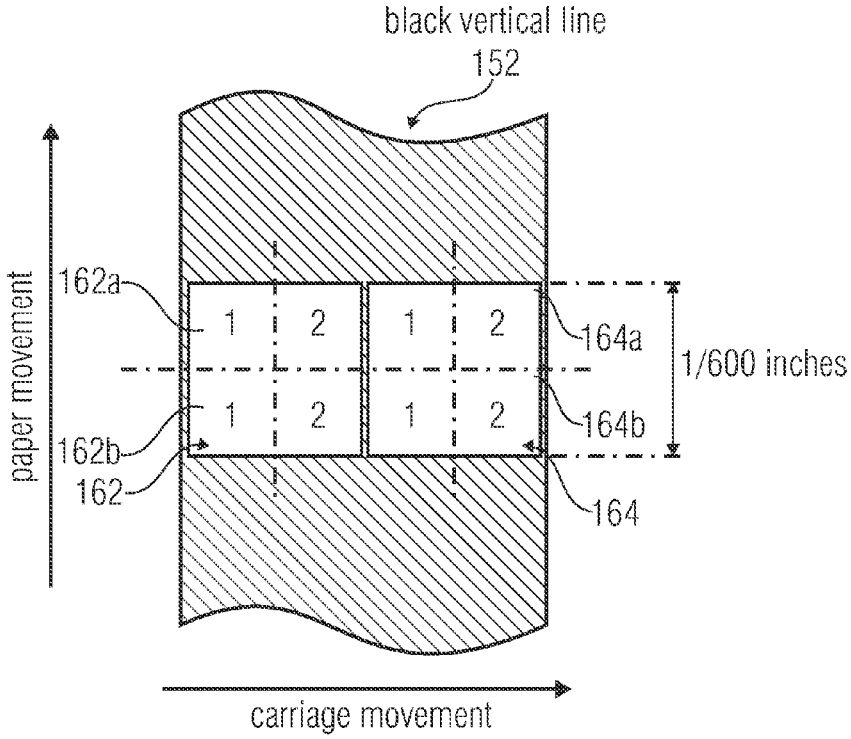

As was described above, when using pigmented inks in thermal inkjet printers a problem arises when the print head has been idle for a specific time, for example for more than one second. In this situation, ink drops with a correct volume and shape will only be obtained after having fired a few drops, for example three ink drops may be enough to get a good drop volume and a good shape. Dependent on the environmental settings and the parameters of the print head also more ink drops or less drops may be required to reach the desired drop volume and drop shape. Conventional masks used for printing with DK print heads fire the same amount of drops independent of the image content to print. This works fine for single-trench matte black print heads, however, when using a DK print head and when printing thin lines or edges of area fills conventional masks provoke a severe line roughness that is visible in the printout. FIG. 3(*a*) shows an example of five vertical black lines that are printed using a DK print head as it is for example shown in FIG. 1 using a conventional, so called single-dotting mask. In FIG. 3(*a*), five vertical lines 152 to 160 are shown. When printing lines 152 to 160 with a DK print head ink drops from both trenches are used. To obtain an acceptable line roughness ink drops with a correct volume and a correct shape have to be fired from the trenches, however, after the print head has been idle for a specific time period it may take some time to obtain the desired drop volumes and shapes as outlined above. This is especially severe in the DK print head as it takes the double number of ink drops to obtain the correct ink drop volume and shape in comparison to a single-trench matte black print head. For example, assume the situation discussed above in accordance with which it is necessary for a trench to fire three ink drops consecutively before getting a drop with a correct volume and shape. For a DK print head with two matte black trenches the amount of drops needed to start getting acceptable line quality is double, which means that the lines printed with the first six drops will have a severe line roughness clearly visible in the printout. FIG. 3(*a*) shows black vertical lines 152 to 160 each having a width of two pixels. Assuming a resolution of 600 dots per inch this means that each pixel has a size of the square of 1/600 inch. Looking at FIG. 3(*a*) and assuming that printing started at the upper left hand corner it can be seen that the upper halves 152*a* and 154*a* of the two leftmost lines 152, 154 were printed with the first eight dots fired in the horizontal direction by a DK print head, and the following lines 156 to 160 were printed with consecutive drops. As can be seen from the upper halves 152*a* to 160*a* of all lines the line roughness significantly decreases as the number of ejected ink drops increases which, in turn, means that the ink drops reach a correct volume and shape. The bottom halves 152*b* to 160*b* of the lines 152 to 160 were printed with ink drops of the correct volume and shape and show a desired and acceptable line roughness. The idle time after completing the upper part 150*a* of the right most line 160 between completing the printing of this upper part 160*a* and forwarding the paper for printing the lower part 160*b* was short enough so that upon continuing the printing the correct amount of ink and the correct shape of the ink drops were ejected by the print head.

FIG. 3(*b*) shows a single-dotting mask that was used to print the vertical lines 152 to 160 shown in FIG. 3(*a*). FIG. 3(*b*) shows a single black vertical line, for example line 152 having a width of two pixels having an area of 1/600 inch×1/600 inch. In FIG. 3(*b*), pixels 162 and 164 are shown. Pixels 162, 164 are generated by printing four ink drops to the print medium, wherein in each pixel 162, 164 two adjacent drops are provided in a first row 162*a* and in a second row 162*b*. Also, the second pixel 164 is printed by applying two adjacent ink drops in two rows 164*a* and 164*b*. In FIG. 3(*b*) a movement of the carriage (see FIG. 2) is indicated, as well as a movement of the paper (see FIG. 2). The numbers in each pixel or cell 162, 164 denote the trench that has fired the ink drop to fill their position. It can be seen that the lines to be generated, for example line 152 are four drops wide. The single-dotting mask shown in FIG. 3(*b*) alternates ink drops from the two trenches to draw the line. This single-dotting mask yields for the first two vertical lines 152 and 154 an unacceptable roughness because alternate dots from both trenches are fired in the horizontal pixels/cells. Thus, after an idle time and assuming that for obtaining a desired roughness each trench must have fired at least three ink drops the line roughness is decreased and finally reaches an acceptable result only after having printed the first two lines 152, 154 as then each trench has ejected at least three ink drops resulting in the correct ink drop volume and shape required for obtaining lines with a reduced roughness.

Therefore, there is a need for providing a new approach for printing thin lines or area fill edges with a reduced roughness from the very beginning of the print process. Embodiments of the invention teach the provision of specific masks that are applied when thin lines or area fill edges are detected in an image to be printed. These new masks maximize the amount of consecutive ink drops fired by the nozzles in a trench. In this way, for example all three drops are fired quicker so that the line roughness it produces affects a lower number of pixels in the printout. This minimizes the line roughness and will be described in the following in further detail with regard to FIG. 4.

Figure 4A:
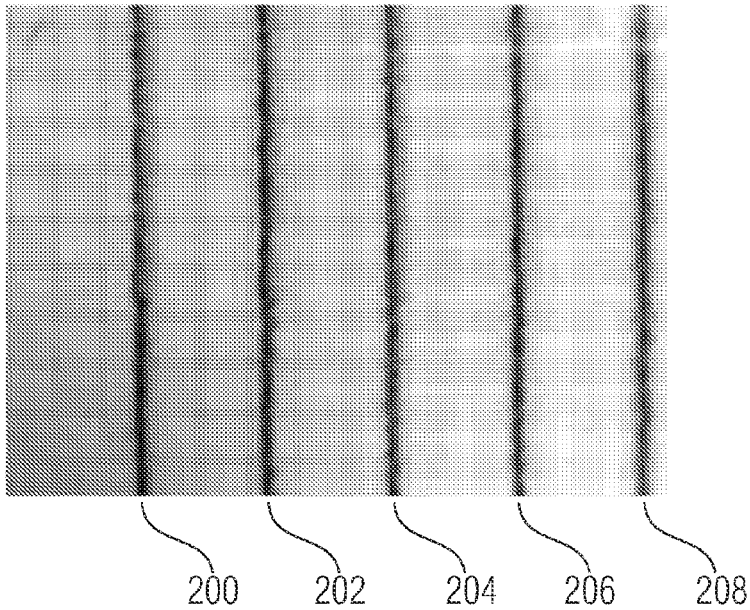
FIG. 4(*a*) is a photographic representation of vertical black lines printed with a DK print head in accordance with an embodiment of the invention.
Figure 4B:
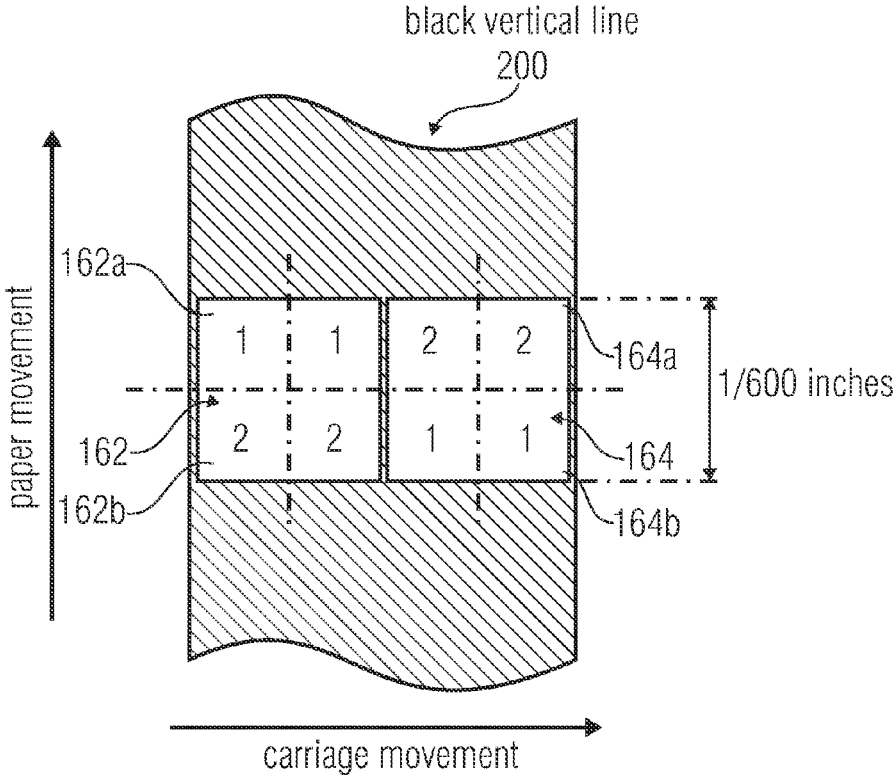

FIG. 4(*a*) is a photographic representation of five vertical black lines 200 to 208 printed using a DK print head and a mask in accordance with an embodiment of the invention, a so-called double-dotting mask. FIG. 4(*b*) shows an embodiment of the double-dotting mask that was used to print the vertical lines illustrated in FIG. 4(*a*). In a similar manner as in FIG. 3(*b*) also FIG. 4(*b*) shows a part of a black vertical line, for example line 200 shown in FIG. 4(*a*). Again, the black line has a width of two pixels 162 and 164 each being printed by two rows 162*a*, 162*b* and 164*a*, 164*b*, respectively, of adjacent ink drops. When compared to FIG. 3(*b*), instead of using alternating ink drops from the two trenches to draw the line, the double-dotting mask according to an embodiment of the invention uses two consecutive drops from each trench. More specifically, while in accordance with FIG. 3(*b*) the first row 162*a* of the first pixel 162 was obtained by firing a first ink drop from a first trench, for example from the nozzles associated with trench 112 (see FIG. 1) and a second ink drop from nozzles associated with the second trench 118 (see FIG. 1), in accordance with an embodiment of the invention shown in FIG. 4(*b*) the first row 162*a* of the pixel 160 is formed by two consecutive ink drops generated by the nozzles associated with the first trench 112. Then, in the next pixel 164 the ink drops for the first row 164*a* are fired by the ink nozzles associated with the second trench 118. The second row 162*b* and 164*b*, respectively, is generated by consecutive ink drops ejected by nozzles associated with the second trench 118 and the first trench 112, respectively. A comparison of FIGS. 3(*a*) and 4(*a*) shows that the line roughness is drastically reduced by applying the mask of FIG. 4(*b*), especially for the upper half of the two leftmost lines shown in FIG. 4(*a*). Thus, consecutively firing two ink drops from the same trench helps reducing the line roughness. The third ink drop is already generated for the second vertical line 202, i.e. already in the first line for each pixel two ink drops from the same trench are generated thereby providing for an ink drop volume and shape being closer to the desired ink drop volume and shape amount of the ink drop. The improvement is obvious from a comparison of FIGS. 4 and 3 and shows that the double-dotting mask of an embodiment of the invention is useful to reduce the line roughness when printing thin lines or area fill edges. Once the necessary numbers of ink drops is generated by one trench, in general, the print process goes back to using the single-dotted mask shown in FIG. 3(*b*) to avoid reliability problems when printing thicker lines or area fills following an area fill edge. The reason for this is that by using the double-dotting masks the printhead's optimal firing frequency is exceeded. It is for this reason that after having printed the first four pixels (at 600 dpi) of a line or an area fill with a double-dotting mask, the method will change back to the single-dotting mask described above with regard to FIG. 3.

Thus, the method in accordance with an embodiment of the invention uses the same trench for generating consecutive ink drops for a pixel following an idle time of the print head exceeding a predefined time limit which may for example be due to the stop of the print process when forwarding the paper to the next swath. This approach results in a faster refresh of the ink within the trench so that the required ink drop volume is reached faster so that the negative effects of the line roughness will only be in a very small part of the printout. However, as mentioned above, this new mode may exceed the maximum firing frequency (drops per second) so that after some time there may not be sufficient ink to refresh the trench and the drop volume may decrease. To be more specific, at the maximum firing frequency the refresh rate of the trench is such that a desired drop volume is insured, however exceeding this firing frequency will reduce the ink volume again, thereby reducing the print quality.

The approach as described above with regard to embodiments of the invention is advantageous as it allows for maintaining acceptable levels of line quality when printing with a high throughput using a DK print head.

Figure 5:
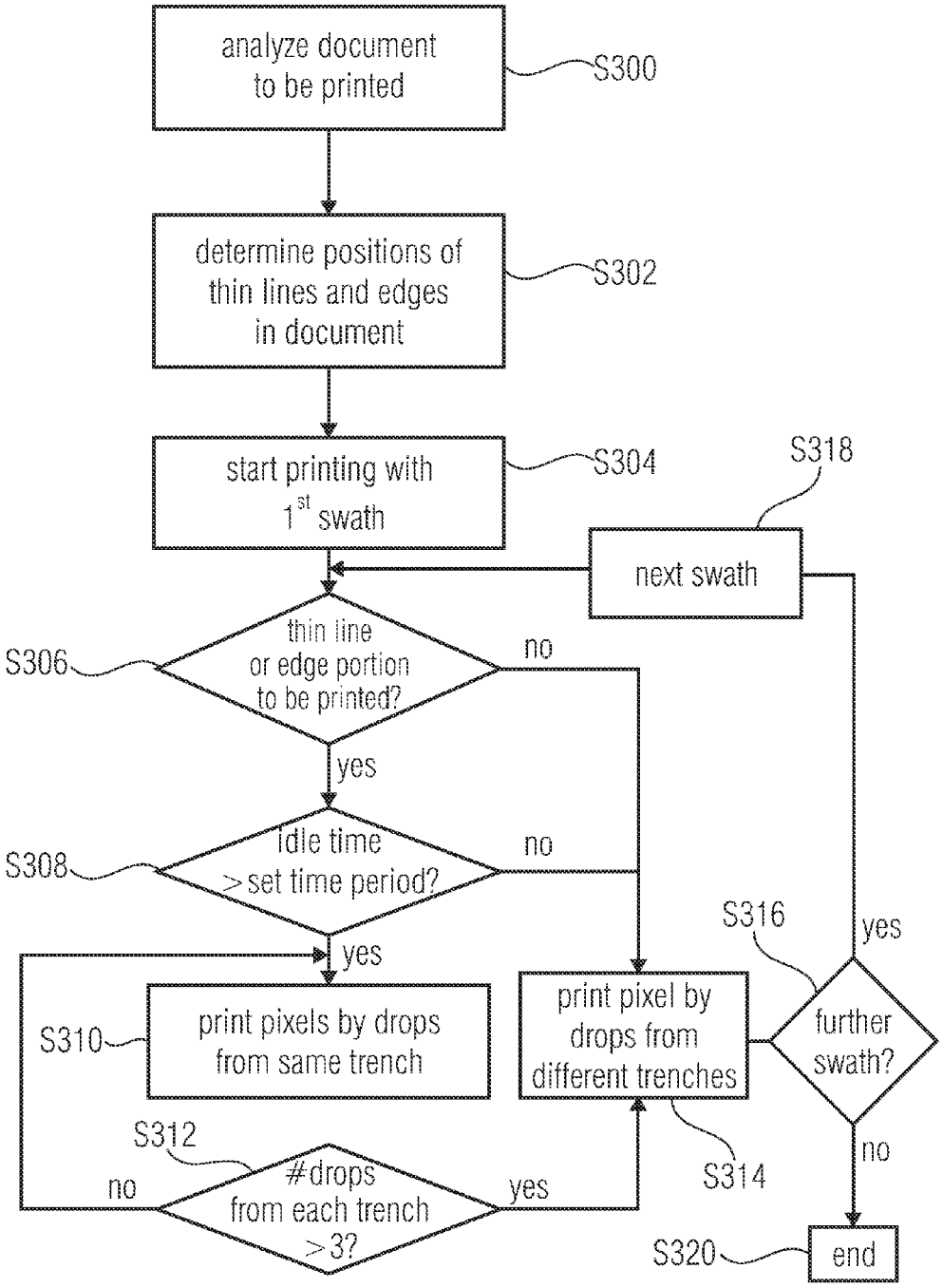
FIG. 5 shows a flow diagram illustrating the method for printing a plurality of pixels according to an embodiment of the invention.

FIG. 5 is a flow diagram illustrating an embodiment of a method for printing a plurality of pixels according to an embodiment of the invention. After having received print data for a document to be printed which may be an image of a CAD plot or the like in a first step S300 the document to be printed is analyzed. On the basis of the analysis in step S302 respective positions of thin lines, for example elements having a number of pixels below a predefined threshold, as well as edges in the image or the document are determined. Once the analysis is completed and the respective thin lines and edges are detected the method proceeds to step S304 where printing is started, in general with a first swath. During printing the first swath it is determined as to whether a thin line or edge position is to be printed, as it is shown in step S306. In case it is determined that a thin line or an edge portion is to be printed the method proceeds to step S308 where it is checked as to whether an idle time exceeded a set time limit. If this is the case, the methods proceeds to step S310 and applies the above described double-dotting mask for printing, i.e. for a pixel being formed of a plurality of ink drops, these drops are printed from the same trench. At step S312 it is checked as to whether the number of drops from each trench reached a predefined threshold, for example three ink drops. In case this is not true the method goes back to step S310.

In case it is determined in step S306 that no thin line and no edge portion is to be printed the method proceeds to step S314 where printing is done using the single-dotting mask as described with regard to FIG. 3, i.e. a pixel formed by a plurality of drops is printed by drops from different trenches. Also in case the idle time did not exceed the set time period the method goes from step S308 also to step S314. Likewise, once it is determined in step S312 that sufficient ink drops were ejected or fired from each trench the method proceeds to step S314. At step S316 it is determined whether a further swath is to be printed, and in case it is the method proceeds to step S318 for processing the next swath. Otherwise, the process ends at step S320.

Figure 6:
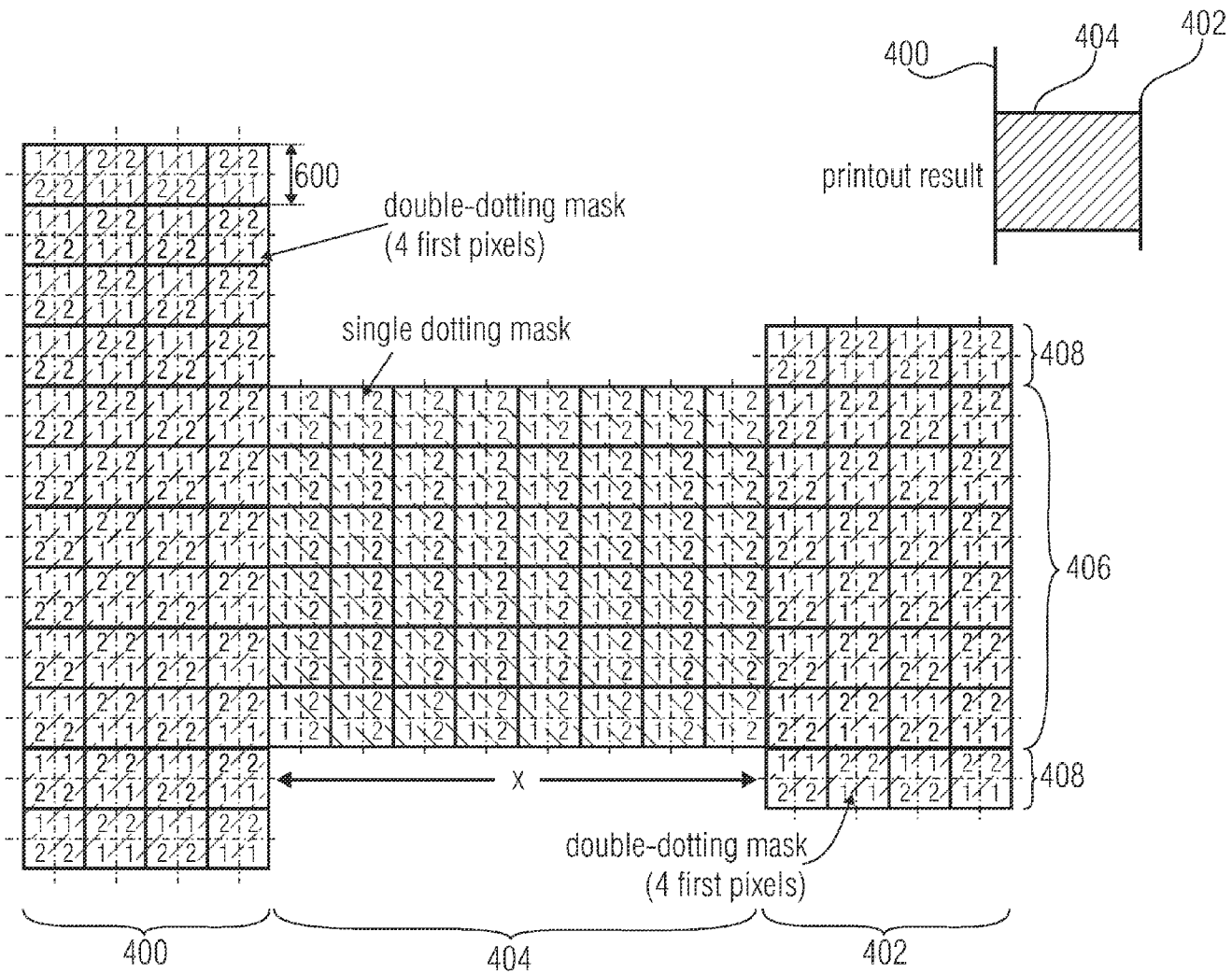
FIG. 6 shows an example of how single and double-dotting masks are applied when printing both lines and area fills.

With regard to FIG. 6 an example is described of how single and double-dotting masks may be applied when printing both thin lines and area fills using the embodiment described with regard to FIG. 5. In the upper right hand corner of FIG. 6 the printout result is shown, namely a structure having a thin line 400 printed on the left side and another thin line 402 printed on the right side and being shorter than the first line 400. Between these two lines 400, 402 an area fill region 404 is defined such that both lines 400 and 402 extend beyond the area fill 404. The large part of FIG. 6 indicates for the lines 400, 402 and for the area fill 404 the respective masks that are applied, namely double-dotting masks for printing the line elements 400, 402 and single-dotting masks for printing the area fill. It is noted that for printing the line 402 the double-dotting masks in area 406 may be replaced by single-dotting masks, dependent on the printing algorithm used. For example, a printing algorithm distinguishing between area fill elements and line elements will recognize part 402 as being a line element and will apply the double-dotting masks. Other embodiments may recognize that the pixels in section 406 of line 402 are consecutive with respective pixels in the fill area 404 so that in such an algorithm instead of using the double-dotting masks in area 402 also the single-dotting masks may be used.

In areas 408 of the line element 402 the double-dotting masks are used. Assuming the inkjet printhead moving from left to right it is apparent that the distance x between the pixels of the first line element 400 and the pixels of the second line element 402 is such that a time period needed for crossing this "gap" may exceed the idle time so that it is beneficial to use the double-dotting mask in part 408 of the line element 402 again.

Figure 7:
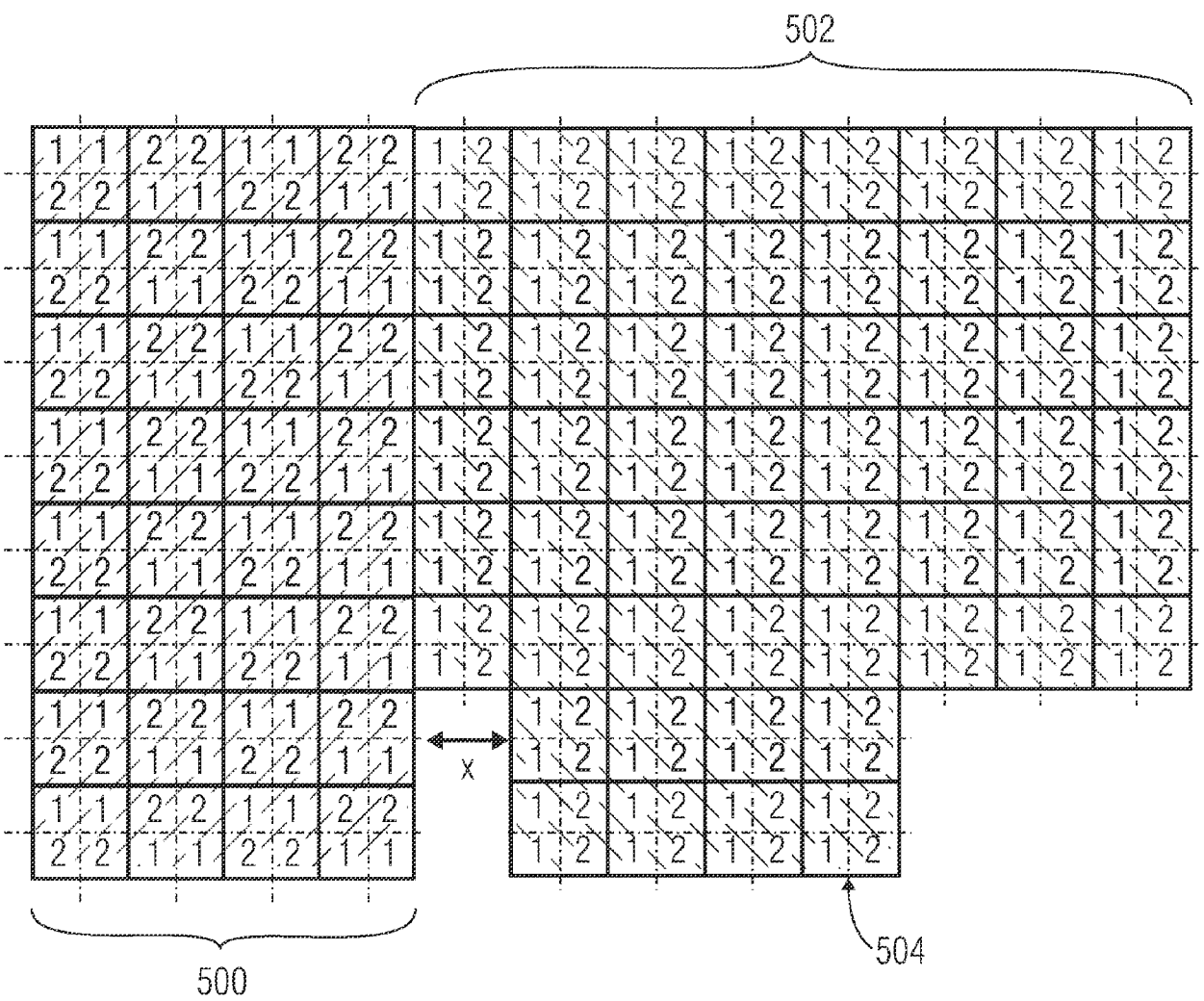
FIG. 7 shows another example of how single and double-dotting masks are applied when printing both lines and area fills.

FIG. 7 shows another example of combining single and double-dotting masks when printing both lines and area fills. In FIG. 7 a line element 500 using double-dotting masks is shown followed by an area fill 502 using single-dotting masks. The area fill 502 has an extension 504 being arranged with an offset of one pixel from the lower part of the line element 500. As can be seen, despite the fact that element 504 would also qualify as a line element, the distance between the pixels in line element 500 and element 504 is quite small so that when passing the "idle pixel" without printing the idle time of the print head will be below a threshold so that printing in portion 504 will be done using the single-dotting mask.

Figure 8:
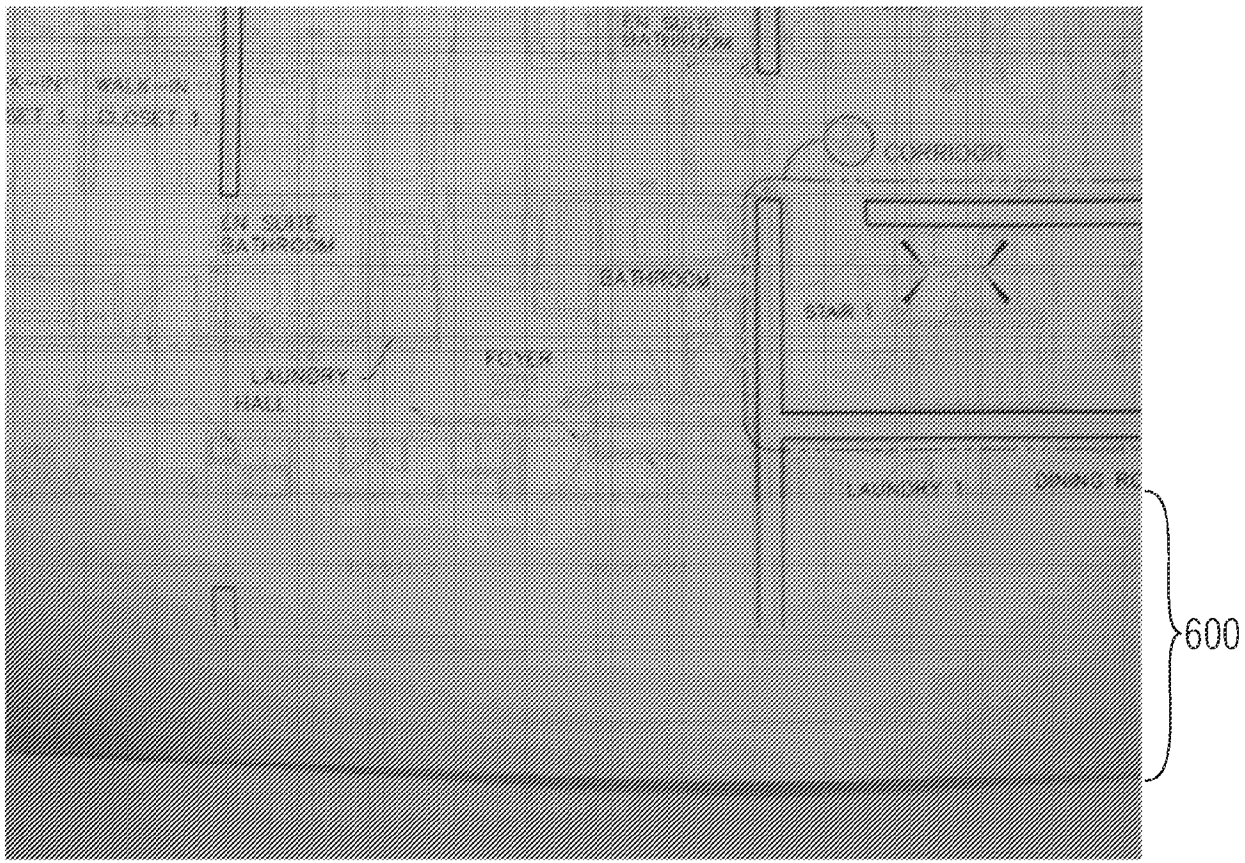
FIG. 8 is a photographic representation of a part of a plot printed on an inkjet apparatus of an embodiment of the invention using a method for printing a plurality of pixels according to an embodiment of the invention.
Figure 9:
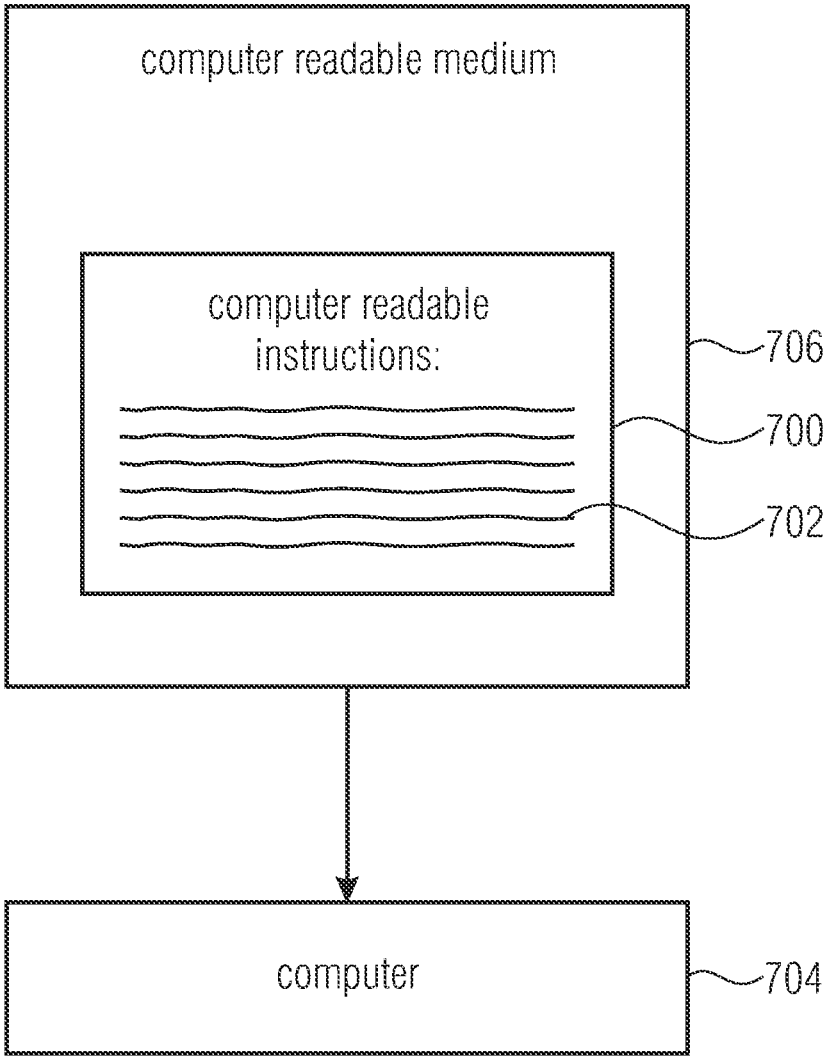
FIG. 9 is a schematic representation of a computer system in accordance with an embodiment of the invention.

Another aspect of the invention relates to the way ink is distributed among consecutive print mode passes. Ink quality may be improved not only by means of the printing mask described above which is changed dependent from an image content, but also by the way the ink is distributed. Conventional approaches using a two pass print mode equally distribute the ink among the two passes, namely 50% of the ink was fired in the first pass and 50% was fired during the second pass. To extract the full potential of a DK print head it is desired to fire the highest amount of ink drops during the same pass, and therefore in accordance with the embodiment of the invention, when printing thin lines same are printed during the same path and only 20% of the ink is fired during the first pass and the remaining 80% are fired during the second pass. Other embodiments print during the first pass 10% to 30% of the ink and during the second pass 70% to 90%. In other embodiments, the higher amount of ink may be printed during the first pass, and the lower amount of ink may be printed during the second pass. FIG. 8 is an example of a plot printed in accordance with an embodiment of the invention. Thicker lines are printed in a first pass and thinner lines are printed in a second pass thereby producing crisp thin lines while printing at high carriage speed. The printout shown in FIG. 3 shows a plot printed with two pass print mode, and in the last swath 600 it can be seen that only line and text with thicker lines have been printed, only on the second pass the thin lines will be printed using a mask selected on the basis of the principles outlined above. A reason to fire different amounts of ink in consecutive passes is to print the maximum quantity of lines in a plot on the same pass. The lower amount may be fired during the second pass or during the first pass as long as the maximum quantity of lines or all lines are printed on the same pass. This is advantageous as no bidirectional alignment errors will occur and, therefore, the vertical line straightness (VLS) will be at an optimum.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention may be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Embodiments of the invention comprise a data carrier having electronically readable control signals, which are capable of cooperating with a programmable computer system, such that one of the methods described herein is performed.

Generally, embodiments of the present invention may be implemented as a computer program product with a program code, the program code being operative for performing one of the methods when the computer program product runs on a computer. The program code may for example be stored on a machine readable carrier. Embodiments comprise the computer program for performing one of the methods described herein, stored on a machine readable carrier. In other words, an embodiment of the inventive method as it is schematically shown in FIG. 5 is, therefore, a computer program 700 having a program code 702 for performing one of the methods described herein, when the computer program 700 runs on a computer 704. An embodiment of the inventive methods is, therefore, a data carrier 706 (or a digital storage medium, or a computer-readable medium) comprising, recorded thereon, the computer program 700 for performing one of the methods described herein.

An embodiment comprises a processing means, for example a computer, or a programmable logic device, configured to or adapted to perform one of the methods described herein. An embodiment comprises a computer having installed thereon the computer program for performing one of the methods described herein. Embodiments may use a programmable logic device, such as a FPGA (field programmable gate array) or an AISIC (application specific integrated circuit) to perform some or all of the functionalities of the methods described herein. A field programmable gate array may cooperate with a microprocessor in order to perform one of the methods described herein. Generally, the methods may by performed by any hardware apparatus.

The above described embodiments are merely illustrative for the principles of the invention. It is understood that modifications and variations of the arrangements and the details described herein will be apparent to others skilled in the art. It is the intent, therefore, to be limited only by the scope and spirit of the impending patent claims and not by the specific details presented by way of description and explanation of the embodiments herein.

What is claimed is:

1. A method for printing a plurality of pixels, the method comprising:

determining if an idle time between printing pixels has exceeded a predefined time period;

based on the idle time exceeding the predefined time period, printing a plurality of first pixels from an inkjet print head by firing two consecutive ink drops from a same trench at different positions in a print head movement direction, the print head having a plurality of trenches supplying ink to a plurality of sets of nozzles; and based on the idle time not exceeding the predefined time period, printing a plurality of second pixels from an ink jet print head by firing two consecutive ink drops from different trenches at different positions in a print head movement direction.

2. The method of claim 1, wherein the first pixels are pixels representing lines having a number of pixels in the print head movement direction below a predetermined value or representing area fill edges oriented in a paper movement direction.

3. The method of claim 1, wherein the idle time is a predefined time period since last firing of the inkjet print head.

4. The method of claim 1, wherein the idle time is the time period during which a print medium is advanced in a printer and during which the inkjet print head is not fired.

5. The method of claim 1, wherein first pixels are printed until a predefined number of ink drops are fired from the same trench, whereupon second pixels are printed.

6. The method of claim 1, wherein the at least two ink drops in adjacent pixels are fired from different trenches.

7. The method of claim 1, wherein the print head is controlled to provide for each pixel at least two ink drops at different positions in a paper movement direction, which, for first pixels, are fired from different trenches and which, for second pixels, are fired from the same trench.

8. The method of claim 2, comprising:

analyzing the document to be printed; and on the basis of the analysis, determining pixels representing lines having a number of pixels in the print head movement direction below a predetermined value or representing area fill edges oriented in a paper movement direction as first pixels.

9. The method of claim 1, wherein the inkjet print head is a dual matte black print head comprising:

a first reservoir filled with black ink;

a second reservoir filled with black ink;

a first set of nozzles to which ink is supplied via at least one first trench from the first reservoir; and a second set of nozzles to which ink is supplied via at least one second trench from the second reservoir;

each pixel is formed by two rows of adjacent ink drops in the print head movement direction; and after a predetermined idle time of the inkjet print head, a predetermined number of consecutive pixels is printed such that the first row of one pixel is formed by ink drops fired from one of the first and second trenches, and the second row of the one pixel is formed by ink drops fired from the other of the first and second trenches.

10. The method of claim 1, wherein a pixel is printed by a two pass print mode;

during a first pass a first amount of ink is fired;

during a second pass a second amount of ink is fired; and the first and second amounts are different.

11. A method for printing a plurality of pixels, the method comprising:

analyzing the document to be printed;

on the basis of the analysis, determining pixels representing lines having a number of pixels in the print head movement direction below a predetermined value or representing area fill edges oriented in a paper movement direction as first pixels, and determining in an idle time between printing pixels has exceeded a predefined time period;

based on the idle time exceeding the predefined time period, printing a plurality of first pixels from an inkjet print head by firing two consecutive ink drops from a same trench at different positions in a print head movement direction, the print head having a plurality of trenches supplying ink to a plurality of sets of nozzles; and based on the idle not exceeding the redefined idle time period, printing a plurality of second pixels from an inkjet print head by firing two consecutive ink drops from different trenches at different positions in a print head movements.

12. A computer readable medium comprising computer-readable instructions for performing a method for controlling an inkjet printing apparatus for printing a plurality of pixels, when the computer-readable instructions are executed by a computer, the method comprising:

determining if an idle time between printing pixels has exceeded a predefined time period;

based on the idle time exceeding the predefined time period, printing a plurality of first pixels by controlling an inkjet print head by firing two consecutive ink drops from a same trench at different positions in a print head movement direction, the print head having a plurality of trenches supplying ink to a plurality of sets of nozzles; and based on the idle not exceeding the predefined idle time period, printing a plurality of second pixels from an inkjet print head by firing two consecutive ink drops from different trenches at different positions in a print head movements.

13. An inkjet printing apparatus, comprising:

an inkjet print head comprising:

a plurality of reservoirs configured to hold ink;

a plurality of sets of nozzles configured to fire ink drops;

a plurality of one or more trenches configured to supply ink from a respective ink reservoir to an associated set of nozzles; and a controller configured to:

determining if an idle time between printing pixels has exceeded a predefined time period;

based on the idle time exceeding the predefined time period, control the inkjet print head such that plurality of first pixels are printed from the inkjet print head by firing two consecutive ink drops at different positions from a same trench in a print head movement direction, the print head having a plurality of trenches supplying ink to a plurality of sets of nozzles;

based on the idle not exceeding the predefined idle time period, printing a plurality of second pixels from an inkjet print head by firing two consecutive ink drops from different trenches at different positions in a print head movements.

14. The inkjet printing apparatus of claim 13, wherein the controller is configured to control the inkjet print head such that first pixels are printed until a predefined number of ink drops are fired from the same trench, whereupon second pixels are printed, and control the inkjet print head such that the at least two ink drops in adjacent pixels are fired from different trenches.

15. The inkjet printing apparatus of claim 13, wherein the inkjet print head is a dual matte black print head comprising:

a first reservoir filled with black ink;

a second reservoir filled with black ink;

a first set of nozzles to which ink is supplied via at least one first trench from the first reservoir; and a second set of nozzles to which ink is supplied via at least one second trench from the second reservoir;

wherein the controller is configured to control the inkjet print head such that each pixel is formed by two rows of adjacent ink drops in the print head movement direction; and that after a predetermined idle time of the inkjet print head, a predetermined number of consecutive pixels is printed such that the first row of one pixel is formed by ink drops fired from one of the first and second trenches, and the second row of the one pixel is formed by ink drops fired from the other of the first and second trenches.

16. The inkjet apparatus of claim 13, wherein the controller is configured to control the inkjet print head such that a pixel is printed by a two pass print mode;

during a first pass a first amount of ink is fired;

during a second pass a second amount of ink is fired; and the first and second amounts are different.

17. The inkjet apparatus of claim 13, wherein the inkjet print head is a dual matte black print head comprising:

a first reservoir filled with black ink;

a second reservoir filled with black ink;

a first set of nozzles to which ink is supplied via at least one first trench from the first reservoir; and a second set of nozzles to which ink is supplied via at least one second trench from the second reservoir;

the controller is further configured to analyze the document to be printed;

determine, on the basis of the analysis, pixels representing lines having a number of pixels in the print head movement direction below a predetermined value or representing area fill edges oriented in a paper movement direction as first pixels, and control the inkjet print head such that the at least two ink drops forming second pixels of said plurality of pixels following the first pixels in the print head movement direction are fired from different trenches.

18. An apparatus, comprising:

an inkjet print head comprising:

a plurality of means for holding ink;

a plurality of means for firing ink drops; and a plurality of means for supplying ink from a respective means for holding ink to an associated means for firing; and means for controlling the inkjet print head such that each pixel of a plurality of first pixels is printed by controlling an inkjet print head to provide for each first pixel at least two ink drops from a same trench at different positions in a print head movement direction, the print head having a plurality of trenches supplying ink to a plurality of sets of nozzles; and a means for controlling the inkjet print head such that each pixel of a plurality of second pixels is printed by controlling an inkjet print head to provide for each second pixel at least two ink drops from different trenches at different positions in a print head movement direction;

wherein the mean for controlling the inkjet print head prints first pixels if a predetermined time period between printing pixels has been exceeded, else it prints second pixels.

19. A method for printing pixels, comprising:

determining if an idle time between printing pixels has exceeded a predefined time period;

based on the idle time exceeding the predefined time period, printing a first pixel from a print head by firing at least two consecutive ink drops from a same trench at different locations in a print head movement direction, the print head having a plurality of trenches and a plurality of sets of nozzles, each trench associated with a set of nozzles; and based on the idle time not exceeding the predefined time period, printing the first pixel from the print head by firing at least two consecutive ink drops from different trenches at different locations in a print head movement direction.

20. The method of claim 19, further comprising:

printing a second pixel from a print head by firing two consecutive ink drops from different trenches at different locations in a print head movement direction.

* * * * *

UNITED STATES PATENT AND TRADEMARK OFFICE

CERTIFICATE OF CORRECTION

PATENT NO. : 8,469,487 B2
APPLICATION NO. : 12/789808
DATED : June 25, 2013
INVENTOR(S) : Sergio Puigardeu et al.

It is certified that error appears in the above-identified patent and that said Letters Patent is hereby corrected as shown below:

In the Claims:

In column 10, line 4, in Claim 11, delete “idle” and insert -- idle time --, therefor.

In column 10, line 4, in Claim 11, delete “redefined” and insert -- predefined --, therefor.

In column 10, line 24, in Claim 12, delete “idle” and insert -- idle time --, therefor.

In column 10, line 40, in Claim 13, delete “that” and insert -- that a --, therefor.

In column 10, line 47, in Claim 13, delete “idle” and insert -- idle time --, therefor.

Signed and Sealed this
Seventeenth Day of September, 2013

Teresa Stanek Rea

Teresa Stanek Rea
*Deputy Director of the United States Patent and Trademark Office*